US009143874B2

(12) United States Patent
Angst et al.

(10) Patent No.: US 9,143,874 B2
(45) Date of Patent: Sep. 22, 2015

(54) HEARING DEVICE COMPRISING A LOCKING MECHANISM FOR AN EXTERNAL CONNECTOR AND METHOD THEREOF

(75) Inventors: Jan Angst, Hirzel (CH); Erich Dittli, Reichenburg (CH); Paul Portmann, Lachen (CH); Marius Rufenacht, Stafa (CH); Andreas Uhlman, Mollis (CH)

(73) Assignee: PHONAK AG, Stafa (CH)

( * ) Notice: Subject to any disclaimer, the term of this patent is extended or adjusted under 35 U.S.C. 154(b) by 0 days.

(21) Appl. No.: 14/115,151

(22) PCT Filed: May 4, 2011

(86) PCT No.: PCT/EP2011/057094

§ 371 (c)(1),
(2), (4) Date: Nov. 1, 2013

(87) PCT Pub. No.: WO2012/149963

PCT Pub. Date: Nov. 8, 2012

(65) Prior Publication Data

US 2014/0079262 A1 Mar. 20, 2014

(51) Int. Cl.

| | |
|---|---|
| ***H04R 1/02*** | (2006.01) |
| ***H04R 25/00*** | (2006.01) |
| ***H01R 13/447*** | (2006.01) |
| ***H01R 13/52*** | (2006.01) |
| *H04R 5/02* | (2006.01) |

(52) U.S. Cl.

CPC ..... *H04R 25/65* (2013.01); *H01R 13/447* (2013.01); *H01R 13/5202* (2013.01); *H04R 25/556* (2013.01); *H04R 25/602* (2013.01); *H04R 25/608* (2013.01); *H04R 5/02* (2013.01); *H04R 25/60* (2013.01); *H04R 2420/09* (2013.01); *Y10T 29/49826* (2015.01)

(58) Field of Classification Search

USPC ..... 381/332, 323, 328, 384

See application file for complete search history.

(56) References Cited

U.S. PATENT DOCUMENTS

| | | | | |
|---|---|---|---|---|
| 579,567 | A | 3/1897 | Earl | |
| 5,646,598 | A * | 7/1997 | Nickles et al. | 340/628 |
| 8,385,573 | B2 * | 2/2013 | Higgins | 381/322 |
| 2007/0183612 | A1 | 8/2007 | Ochsenbein et al. | |
| 2008/0095390 | A1 | 4/2008 | Gebert et al. | |

FOREIGN PATENT DOCUMENTS

| | | | |
|---|---|---|---|
| DE | 202 05 922 | U1 | 8/2002 |
| EP | 0 087 668 | A1 | 9/1983 |
| WO | 2008/095505 | A1 | 8/2008 |

OTHER PUBLICATIONS

International Search Report for PCT/EP2011/057094 dated Mar. 20, 2012.

Written Opinion for for PCT/EP2011/057094 dated Mar. 20, 2012.

* cited by examiner

*Primary Examiner* — Davetta W Goins
*Assistant Examiner* — Amir Etesam
(74) *Attorney, Agent, or Firm* — Pearne & Gordon LLP

(57) ABSTRACT

A hearing device comprising a locking mechanism for connecting an external component to the hearing device, the locking mechanism comprising a part (2) arranged at or in the housing wall (1) of the hearing device, moveable from or out of the housing wall such that by moving the part back towards the housing wall a section of the part is fixing a connecting element of the external component to the hearing device or housing of the hearing device respectively.

11 Claims, 3 Drawing Sheets

HEARING DEVICE COMPRISING A LOCKING MECHANISM FOR AN EXTERNAL CONNECTOR AND METHOD THEREOF

The present refers to a hearing device according to the preamble of claim 1 and a process for the attachment of an external component to a hearing aid.

In practice, the present invention refers to a locking mechanism for the mechanical fixation of an external component, such as e.g. a receiver placed inside an ear canal, an acoustic sound tubing or the like to an externally worn hearing aid.

The requirement to such a mechanism is that it must be very small sized, ensure easy handling with no special tools needed and ensures secure attachment. Furthermore, it must ensure high freedom of exterior design of the hearing aid housing and connector, and that it cannot be lost during normal handling by the operator. The combination of all these aspects has so far not been realized with another interlocking means for attachment of external receivers or the like to hearing aids.

Current solutions for attachment of external receivers include simple through-hole pins, snap-on connection on housing or internal frame, locking by fixation spring, simple press-fit of plug in socket, bayonet coupling, locking by a further part such as a microphone protection means.

E.g. the U.S. 2007/0183612 describes a small pin which is inserted laterally and goes through aligned holes in the housing, and/or frame and external receiver plug. Although this solution features a very small size and a secure connection, the main disadvantage is that the pins, being so small, often get lost when the external receiver needs to be detached/attached. This is also a common complaint received from the field.

The U.S. Pat. No. D579,567 describes a snap-on connection on housing/frame. Attachment of external receiver by means of a click-fix mechanism also leads to a secure connection. The disadvantages are the comparably bigger size than other solutions, difficult handling (needs multiple force application in different directions at the same time) and a limitation in design freedom, if the external receiver is to be used with different hearing aids.

The WO2008095505A1 describes an interlocking fixation spring. Fixation of the plug in the socket by means of a flexible spring is a relatively space-saving solution. However, the disconnection force is crucial: if the retention force is too high, the external receiver is likely to get damaged (e.g. tubing will stretch over its elastic limit and litzwires are destroyed). If the force is lower to prevent said damage, there is a risk that the plug will be unintentionally removed from the socket, resulting in possible loss of the hearing aid. A dedicated locked/unlocked mechanism does not pose this risk.

The US20080095390A1 describes a bayonet coupling. A bayonet coupling is a secure fixation and handling is relatively simple. On the other hand, this solution is not ideal in terms of space-saving. It requires a more or less cylindrically shaped connector, which considerably limits freedom of design as well. Furthermore the size of this coupling cannot be too small, since the user should be able to operate the mechanism with his fingers.

It is therefore an object of the present invention to provide a sealed solution for interlocking an external component to a hearing aid or hearing aid housing respectively.

The ideal interlocking mechanism for an external component such as receivers or the like to a hearing aid should offer the following features:

- Be very small in size (cosmetic/design aspects).
- Provide easy handling, no special tooling required to operate the mechanism.
- Provide a secure connection (clear locked/unlocked condition) to prevent from unintended release.
- Should not include parts which are to be removed during operation of the mechanism—the mechanism should be captive.
- Should not, or only to a very limited degree, influence the exterior design of the hearing aid. This will facilitate the use of the same external receiver for multiple, differently designed hearing aids, which lowers cost and gives considerably more freedom of design.
- Sealed connection, to enhance user reliability (splash water protected hearing aids)

As a consequence, the present invention proposes a hearing aid according to the wording of claim 1.

The hearing aid comprising a locking mechanism for connecting an external component to the hearing aid is characterized in that the mechanism comprising a part arranged at or in the housing wall of the hearing aid, (pivotably) movable from or out of the housing wall such that by (pivotably) moving the part back towards the housing wall a section of the part is fixing a connecting element of the external component to the hearing aid or housing of the hearing aid respectively.

According to one embodiment the part of the locking mechanism is part of the housing wall.

According to a further embodiment the part of the locking mechanism is pivotably arranged around an axis within the housing and is connected to the housing by means of a pin, cam, pivot bolt, etc.

It is also possible to have a glued connection instead of a Pin, to use e.g. elastic characteristics of respective elastic materials suitable lobe used.

Furthermore, it is proposed that the locking mechanism comprising a latch-like part covering at least part of the housing wall in the area of the connecting element of the external component, which by the pivot movement of the latch-like part of the locking mechanism is fixing the connecting element by clamping, by squeezing, by snapping, etc.

The connecting element of the external component such as e.g. an external receiver placed e.g. inside the ear canal can be a plug-like element.

Further possible embodiments of the invention are described within the dependent claims.

The invention is further described by examples, shown in the attached figures.

Figure 1:
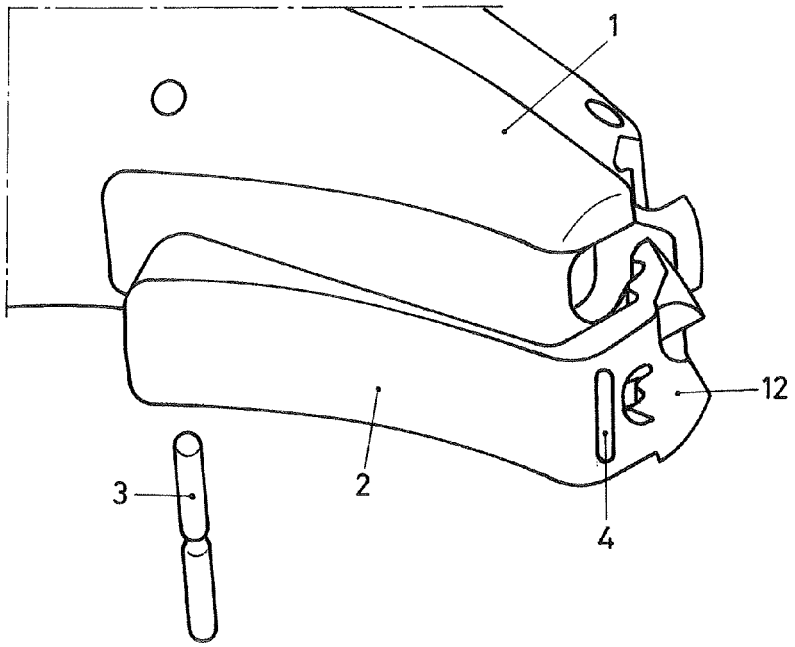
FIG. 1 is showing the locking mechanism, separated from a hearing aid housing.

FIG. 1 shows in perspective view the locking mechanism 2, which is shown separated from the hearing aid housing 1. During assembly the locking mechanism 2 in the form of a flat or clip-like latch can be inserted into the housing 1 and locked by means of a pin 3. The locking mechanism 2 can be made such that when assembled it is an integral part of the hearing aid housing wall.

The locking mechanism 2 has e.g. two defined positions. These positions are obtained by proximal movement of the locking mechanism 2 by applying proximal force/torque with any small enough tool to the channel 4 provided within a bent latch-like part 12 of the mechanism, overlapping the body end of the housing 1 in the area of receiving a plug of an external component. A specific tool is not necessarily required, open and close will work for example with fingernail. Instead of a channel of course e.g. a bulge or a small elevation could be provided.

Figure 2:
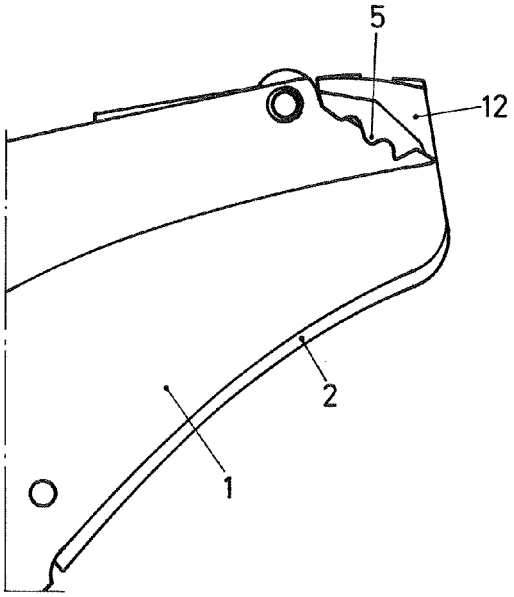
FIG. 2 shows the closed mechanism assembled.
Figure 3:
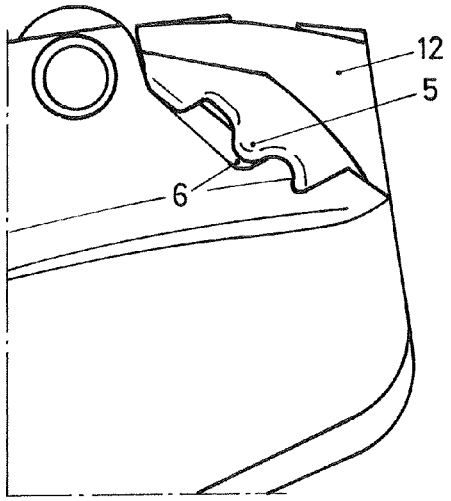
FIG. 3 shows part of FIG. 2 in enlarged view.

As better recognized in FIG. 2, which shows the closed locking mechanism 2, is a catch 5 of the bent latch-like part 12, which snaps in place with a grooving 6 at the housing bottom 1, which is shown enlarged in FIG. 3.

Figure 4:
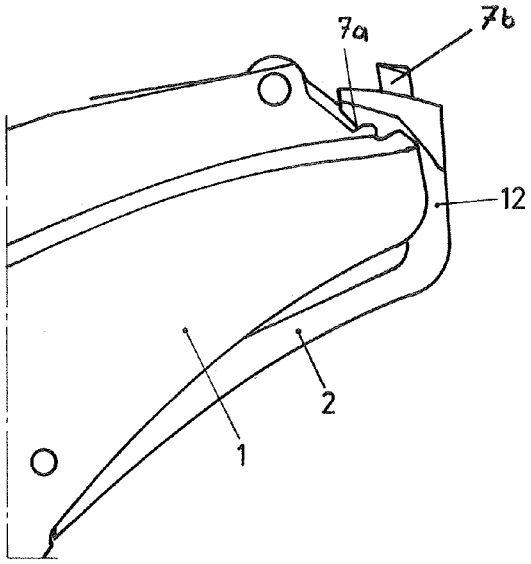
FIG. 4 shows the opened locking mechanism in dead stop position.

FIG. 4 shows the opened locking mechanism 2 in a dead stop position which is defined on one hand by design of a stopper 7*b*, provided within the hearing aid housing 1 and on the other hand with the designed catch 7*a*, provided within the locking mechanism.

Figure 5:
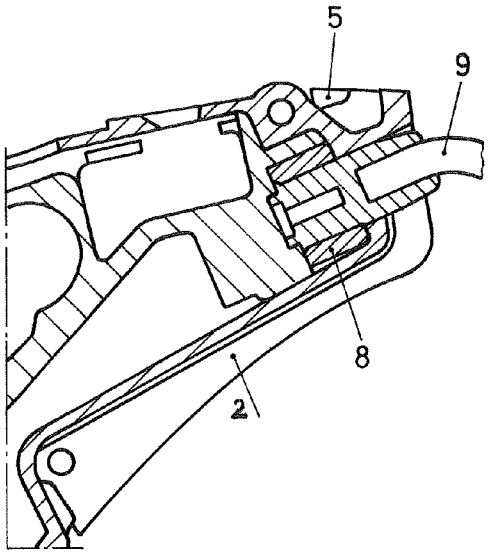
FIGS. 5 and 6 show two positions of the locking mechanism in cross-sectional view.
Figure 6:
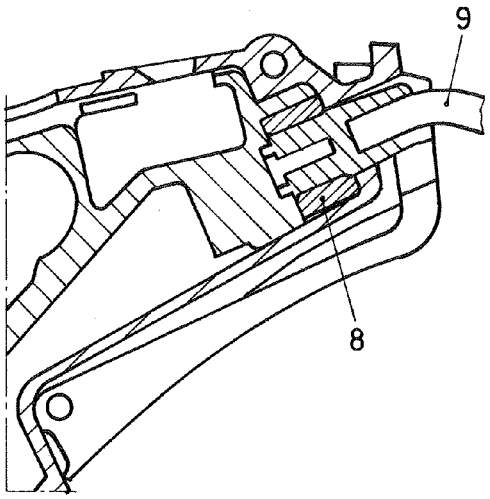

Referring now to FIGS. 5 and 6 the two positions open and closed of the closing mechanism are shown in cross-sectional view with further arranged a sealing ring 8. By pressing a plug 9 of an external component such as e.g. a receiver into the sealing ring 8 a reliable sealing against entry of splash water, sweat or other liquids (Hairspray, Sunlotion, bodylotion etc.) is warranted.

In FIG. 5 the locking mechanism 2 is in closed position, so that the plug is firmly fixed by clamping due to the firm attachment of catch 5.

FIG. 6 shows the locking mechanism in open position similar to FIG. 4 with the possibility to remove the plug 9 away from the seal 8 to disconnect the external component.

Figures 7, 8:
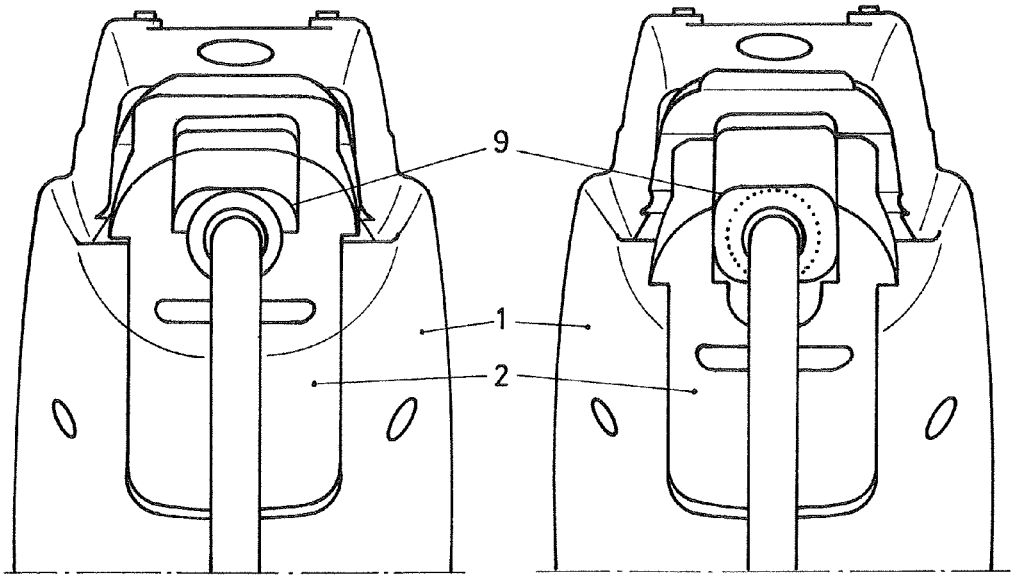
FIGS. 7 and 8 show in view on the front end of the hearing aid housing the retention of the plug from an external receiver.

FIGS. 7 and 8 show the retention of the plug from e.g. an external receiver from the front view. Thanks to the form-fit holding of e.g. a conical receiver-plug 9 the plug is on one hand prevented from loosing and on the other hand a good sealing against Liquids of the conductive connection between receiver-plug 9 and electronic is achieved.

FIG. 7 shows the firmly locked plug, and FIG. 8 shows the open locking mechanism with the possibility of removing the plug 9 from the hearing aid housing 1.

The locking mechanism 2 is preferably made of a polymeric material, such as e.g. a glass fibre reinforced thermoplastic resin or any stiff and hard enough polymer.

Material examples, not being exhaustive, include: polyamide (PA), polyoxymethylen (POM), polybutylenterephthalat (PBT), polyetheretherketone (PEEK), liquid crystalline polymers (LCP), etc.

The housing 1 is preferably made of a polymeric material as well. Any suitable thermoplastic resin can be used, either filled or unfilled with any kind of filler or reinforcement.

Alternatively, the locking mechanism 2 and/or the housing 1 can be made of a metal or a ceramic material.

Hence, possible combinations include:

polymer housing 1, polymer locking mechanism 2
polymer housing 1, metal locking mechanism 2
polymer housing 1, ceramic locking mechanism 2
metal housing 1, polymer locking mechanism 2
metal housing 1, metal locking mechanism 2
metal housing 1, ceramic locking mechanism 2
ceramic housing 1, polymer locking mechanism 2
ceramic housing 1, metal locking mechanism 2
ceramic housing 1, ceramic locking mechanism 2

The use of materials such as metal or ceramics exhibit several advantages, such as improved strength and wear characteristics, better environmental resistance, less extractable and better biocompatibility in contact with skin, higher-end appearance.

Metal and ceramic parts can be manufactured in different manners. One possibility is to make the parts in a powder injection molding process (PIM). This allows great freedom of design, complex shapes and relatively cost effective production.

Alternatively, such parts can also be made in other technologies, such as machining (metal and ceramic) or cold forming (metal).

Possible metal materials include Titanium, any stainless steel, in particular Nickel-free stainless steel, Aluminium, and any other metal material/alloy which fulfil the required mechanical properties and offer good resistance against acidic corrosion (not attacked by human sweat).

Possible ceramic materials include mainly ZrO2, Al2O3 and variants thereof (e.g. Y2O3 stabilized). Though, any other suitable ceramic material could be considered as well.

The designs as shown by examples in FIGS. 1 to 8 are mainly for the better understanding of the present invention and of course other designs and the use of different materials are possible.

E.g. the grooving 6 on the locking mechanism 2 along with the catch 5 are not absolutely necessary for the proper function of the invented locking mechanism. Alternatively, a friction based solution can be designed as well. In this case, the proximal movement of the locking mechanism 2 is only controlled by the amount of friction between the locking mechanism 2 and the housing 1.

The friction can be influenced by dimensional measures (i.e. less or more play), material selection (inherent coefficients of friction), surface treatment of any of the materials (will alter the coefficient of friction) and addition of further intermediate materials, such as lubricants (solid or liquid/paste-like).

Not all the aforementioned material combinations would work with the suggested grooving 6/catch 5 design.

Combinations not including at least one polymer material either for the housing or for the locking mechanism would require a friction-controlled design.

As another variation of this mechanism, the catching could be placed at a different place for example at the bottom side of the housing top or lateral.

Summarizing up the aforementioned information and the description, the advantages of the present invention are the following:

The suggested interlocking mechanism features a very small size and provides a secure connection with clear locked and unlocked states.

No part has to be removed during handling; loss of small parts is not possible (captive connection).

The interlocking mechanism is fully integrated to the housing 1, not visible from the side. A lot of different designs—along with the one described—are possible.

The handling is very easy, convenient and user-friendly. A special tool is not needed to operate the mechanism.

As this solution retains the plug of the external receiver 9 around its outline, the same connector (external receiver) as for the released CRT-Devices can be used.

This locking mechanism ensures sealed connection between HI and external receiver for stiffer use-cases as for example swimming.

This locking mechanism could be combined with other parts of the HI, for example left/right-identification, labelling, type label etc.

Different colour combinations are possible.

What is claimed is:

1. A hearing device comprising a locking mechanism for connecting an external component to the hearing device and a housing comprising a housing wall and a receiving end, the locking mechanism comprising two approximately perpendicularly extending latch-like parts arranged at the housing wall of the hearing device, movable from or out of the housing wall such that by moving the locking mechanism back towards the housing wall a section of the locking mechanism is fixing a connecting element of the external component to the hearing device, characterized in that one of the latch-like parts of the locking mechanism covering the receiving end of the housing is lockable to the housing wherein, the locking mechanism pivotably movable around an axis within the housing of the hearing device and is held to the axis by means of a pin, cam or pivot bolt.

2. The hearing device according to claim 1, characterized in that the locking mechanism is at least partially part of the housing wall of the hearing device.

3. The hearing device according to claim 1, characterized in that the connecting element of the external component is a plug-like element.

4. The hearing device according to claim 1, characterized in that the one latch-like part of the locking mechanism covering the receiving end of the housing is lockable to the housing by means of a catch, an elevation element or a projection, snapping in a respective grooving or cavity provided within the housing of the hearing device.

5. The hearing device according to claim 1, characterized in that the one latch-like part of the locking mechanism covering the receiving end of the housing comprising a catch, a projection or an elevation element is engageable within a respective grooving or cavity within the housing such that when opening the locking mechanism the mechanism is held within a dead stop position defined by a stopper.

6. The hearing device according to claim 1, characterized in that in an area of introducing the connecting element of the external component, sealing means are arranged to ensure reliable sealing against entry of splash water or sweat.

7. The hearing device according to claim 1, characterized in that the locking mechanism is movable between at least two defined positions, a locking position firmly holding the connecting element of the external component within the housing of the hearing device and an open position for releasing the connecting element, wherein the locking position being such that the locking mechanism is at least almost integral with the housing wall of the housing of the hearing device.

8. The hearing device according to claim 1, characterized in that at least at one section of the locking mechanism a small channel or projecting part is arranged such that the locking mechanism can be moved with any small enough tool such as a fingernail.

9. A process for the of attaching an external component to a hearing aid housing, wherein a connecting element of the external component is firmly connected to the housing by means of a locking mechanism, the locking mechanism comprises two perpendicular approximately perpendicularly extending latch-like parts arranged at a housing wall of the hearing aid, and the locking mechanism being is pivotably moveable around an axis out of the housing wall and back towards the housing wall, the process comprising firmly attaching the connecting element by applying a clamping force from the locking mechanism to the connecting element, and locking the one latch-like part of the locking mechanism covering a receiving end of the housing of the hearing device to the housing.

10. The hearing device according to claim 1, wherein the locking mechanism is movable between at least two defined positions, a locking position holding the connecting element of the external component within the housing of the hearing device and an open position for releasing the connecting element, wherein the two approximately perpendicularly extending latch-like parts are disposed within and/or in contact with at least a portion of the housing in both the locking position and the open position.

11. The hearing device according to claim 4, wherein the catch, elevation element or projection faces inwardly to an end of the housing; and wherein the respective grooving or cavity faces outwardly from the end of the housing.

* * * * *